United States Patent [19]

Mailliet

[11] 4,368,813

[45] Jan. 18, 1983

[54] DISTRIBUTION CHUTE CONTROL APPARATUS AND METHOD

[75] Inventor: Pierre Mailliet, Howald, Luxembourg

[73] Assignee: Paul Wurth S.A., Luxembourg

[21] Appl. No.: 233,139

[22] Filed: Feb. 10, 1981

[30] Foreign Application Priority Data

Feb. 15, 1980 [LU] Luxembourg ..... 82173

[51] Int. Cl.[3] ..... C21B 7/16

[52] U.S. Cl. ..... 193/3; 193/16; 414/160; 414/206

[58] Field of Search ..... 193/2 R, 3, 16, 17; 414/160, 206, 199, 205, 207; 266/176

[56] References Cited

U.S. PATENT DOCUMENTS

| | | | |
|---|---|---|---|
| 3,693,812 | 9/1972 | Mahr et al. | 414/206 |
| 3,814,403 | 6/1974 | Legille | 414/206 |
| 3,880,302 | 4/1975 | Legille | 414/206 |
| 3,899,088 | 8/1975 | Furuya et al. | 414/206 |
| 4,042,130 | 8/1977 | Legille et al. | 414/199 |
| 4,074,816 | 2/1978 | Legille | 414/206 |
| 4,153,140 | 5/1979 | Mahr et al. | 414/206 |

*Primary Examiner*—John J. Love
*Assistant Examiner*—Gene A. Church
*Attorney, Agent, or Firm*—David S. Fishman

[57] ABSTRACT

Control over the direction and inclination of a charge distribution chute within a blast furnace is accomplished with a compact and reliable drive mechanism. The drive mechanism includes a rigid control rod for varying chute inclination angle and a gear drive which translates angular position commands in the form of rotation about a vertical axis to reciprocation of the control rod. The control rod and its gear drive rotate with the chute while simultaneously varying the inclination angle.

10 Claims, 3 Drawing Figures

FIG.1
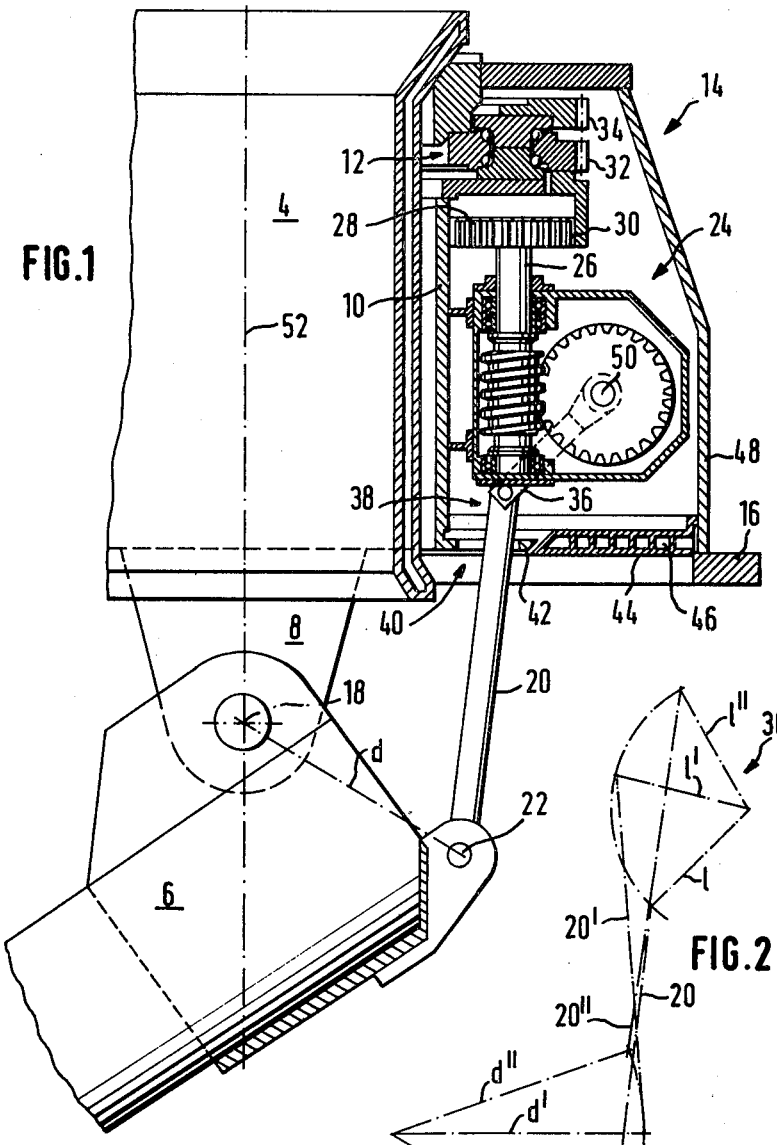
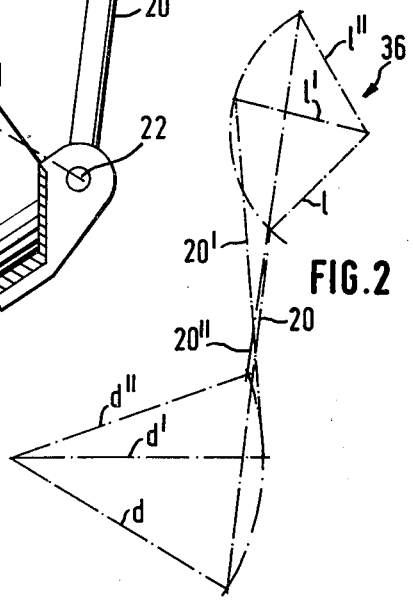
FIG.2

DISTRIBUTION CHUTE CONTROL APPARATUS AND METHOD

BACKGROUND OF THE INVENTION (1) Field of the Invention

The present invention relates to the exercise of control over the aiming of an elongated member, particularly a chute for conveying solid material, and to the application of the said control technique to the charging of pressurized shaft furnaces. More specifically, this invention is directed to apparatus for positioning a rotatable and angularly adjustable charge distribution chute mounted within a furnace. Accordingly, the general objects of the present invention are to provide novel and improved methods and apparatus of such character.

(2) Description of the Prior Art

While not limited thereto in its utility, the present invention is particularly well suited for use in the delivery of solid charge material to the hearth of a blast furnace wherein high pressures are maintained. Modern blast furnace technology demands that the deposition of the material with which the furnace is charged be accurately controlled. This accurate charge distribution control must be achieved in the face of exceedingly high temperatures and operating pressures. Two basic types of charging devices are presently known in the art. The first, which has been in use for many years, employs superimposed bells of unequal diameter. When employing such bells, it is not possible to introduce the charge in an even and uniform manner over the surface of the furnace hearth. The second category of charging device comprises "bell-less" apparatus which employs a rotatable and angularly adjustable distribution chute located within the furnace. The desired charge profile on the furnace hearth may be obtained through exercise of control over the aiming of this chute as the charge material is supplied to the upper end thereof from a pressurized storage hopper. Such "bell-less" charging installations are shown in U.S. Pat. Nos. 3,693,812, 3,814,403, 3,880,302, 4,042,130, 4,074,816 and 4,153,140.

The presently employed mechanisms which rotate the charge distribution chute and adjust its angle of inclination in the "bell-less" charging installations have portions of the drive apparatus exposed to the exceedingly harsh environment which exists in the furnace throat. In the typical installation, the distribution chute is mounted from a rotatable casing which is positioned concentrically around a central feed channel or spout; the central feed spout being coaxial with the furnace and serving to direct the charge material from a storage hopper or hoppers onto the upper end of the controllable chute. Means in the form of a first mechanical drive train imparts rotary motion to the casing to thereby rotate the distribution chute. A further drive train rotates with the casing and independently drives the chute so as to vary the angular orientation thereof with respect to the furnace vertical axis. The rotatable casing, in part, defines an annular chamber in which is positioned the drive train for controlling the distribution chute angular position. This chamber will be separated, but not hermetically isolated, from the interior of the furnace at its lower end by means of an outwardly extending flange on the rotatable casing and a co-planar flange which extends inwardly from the furnace wall. The distribution chute is coupled to the drive means located within the annular chamber by means of a control rod which passes through an aperture in the flange which extends outwardly from the rotatable casing. In operation, the casing, distribution chute, control rod and the means for driving the control rod rotate together about the common vertical axis of the furnace and feed spout under the influence of the first drive train. During this rotation, through operation of the second drive train, the distribution chute may be caused to pivot about its horizontal suspension axis whereby the charge material failling under the influence of gravity to the furnace hearth may be guided by the chute so as to transcribe, by way of example, concentric circles or a spiral pattern.

Co-pending U.S. patent application Ser. No. 65,289 now Pat. No. 4,273,492, which is assigned to the assignee of the present invention, discloses recent improvements in drive mechanisms and techniques for distribution chutes of "bell-less" shaft furnace charging installations. Co-pending application 65,289 teaches the provision of cooling for the annular chamber containing some of the drive mechanisms for the distribution chute. This cooling was typically previously accomplished by delivering, to the interior of this chamber, an inert cooled gas and also by providing for the flow of a liquid coolant in one or both of the rotatable and stationary flanges which define the lower end of the annular chamber. The said co-pending application 65,289 further discoses a distribution chute inclination angle adjustment mechanism which employs a telescoping control rod. The apparatus of the said co-pending application has, as one particularly desirable attribute, the minimizing of the width, measured radially from the furnace axis, of the annular chamber. This minimization of chamber width reduces the area of the base of the chamber and thus also reduces the heat flow from the interior of the furnace to the chamber. Thus, the cooling requirements for the distribution chute drive are reduced by the apparatus of application 65,289. In fact, employing the apparatus of the co-pending application and providing for coolant flow in the flanges which define the base of the annular chamber, the necessity of delivering gaseous coolant into the chamber is obviated.

A disadvantage with the apparatus of co-pending application 65,289 now U.S. Pat. No. 4,275,492 and other prior "bell-less" charge distribution chute control technique resides in the fact that the major portion of the base of the annular chamber, in which the components of the drive system are located, is defined by the outwardly extending annular disc or flange which is integral with the rotary casing from which the chute is suspended. Thus, in order to provide for liquid cooling of this rotating flange, recourse must be had to rotary joints of large diameter. Use of such rotating fluid couplings, particularly those of large diameter, increases the cost of the apparatus and presents potential leakage problems. It has previously been deemed impractical to effect a significant reduction in the width of the rotary flange in order to increase the area of the stationary flange which, of course, is easier to cool. Considering by way of example the apparatus of co-pending application 65,289, the telescopic element of the control rod must, in order to have sufficient strength, be of comparatively large diameter and this control rod element must pass through an opening provided in the rotary flange. Thus, the dimensions of the control rod impose a limit on the dimensions of the relatively hard to cool rotatable disc or flange, this flange in part defining the base of the annular chamber which houses components of the chute drive.

It is also to be noted that the provision of comparatively complicated articulated suspension devices for the driven end of the control rod, such suspension devices being located in the above-mentioned annular chamber, increases the cost of the overall charging installation. It is always desirable to reduce system complexity and thereby reduce cost and enhance reliability.

SUMMARY OF THE INVENTION

The present invention overcomes the above briefly discussed and other deficiencies and disadvantages of the prior art by providing a novel and improved technique for controlling the inclination angle of a rotable member and particularly a shaft furance charge distribution chute. The present invention also comprises apparatus which functions in accordance with the aforesaid method and provides an uncomplicated, and thus reliable and inexpensive, charge distribution chute drive mechanism which is characterized by a high degree of compactness and the ability to have its control rod output member juxtapositioned to the rotary casing which, in part, defines the housing for the said drive mechanism.

Apparatus in accordance with a preferred embodiment of the present invention comprises a gearbox which is fixed to the rotatable casing so as to be disposed within the annular chamber partly defined thereby. This gearbox will have a vertical input shaft, which is generally parallel with the axis of the furnace and rotatable casing, and a horizontal output shaft. The input shaft is driven, typically via a drive train comprising pinion and ring gears, from outside of the annular chamber. The output shaft is coupled, via a connecting rod and pivot connection, to the upper end of the control rod. The lower end of the control rod is, in the known manner, articulated to the distribution chute. The gearbox, which converts the vertical input shaft rotation to a horizontal output shaft rotation, will preferably include a worm gear type translating drive.

Also in accordance with the preferred embodiment of the present invention, the control rod passes through an opening in the customary outwardly extending flange at the lower end of the rotatable casing. The control rod of the present invention is of smaller diameter when compared to the prior art, and particularly when compared to prior art control rods of the telescopic type. Further, because of the means by which it is driven, the control rod of the present invention undergoes comparatively short movements in the radial direction. Accordingly, the point at which the control rod passes through the rotating flange may be juxtapositioned to the wall of the rotary casing and the dimensions of the opening in the flange through which the rod passes may be made comparatively small. The foregoing permits the width of the rotary flange to be minimized and thus permits the base of the annular chamber to be largely defined by an easy to cool stationary flange.

As an added advantage precipitated by the present invention, the heat transferred to a liquid coolant circulated within the comparatively large stationary flange at the base of the annular chamber which houses the distribution chute drive components may be recovered and used for other heating purposes. This fact, coupled with the elimination of the need for delivery of a cooling gas to the interior of the annular chamber, produces substantial savings.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which:

FIG. 1 is a side elevation view, partly in section, of apparatus in accordance with a preferred embodiment of the invention;

FIG. 2 is a kinetic diagram which illustrates operation of the apparatus of FIG. 1.

DESCRIPTION OF THE PREFERRED EMBODIMENT

Figure 3:
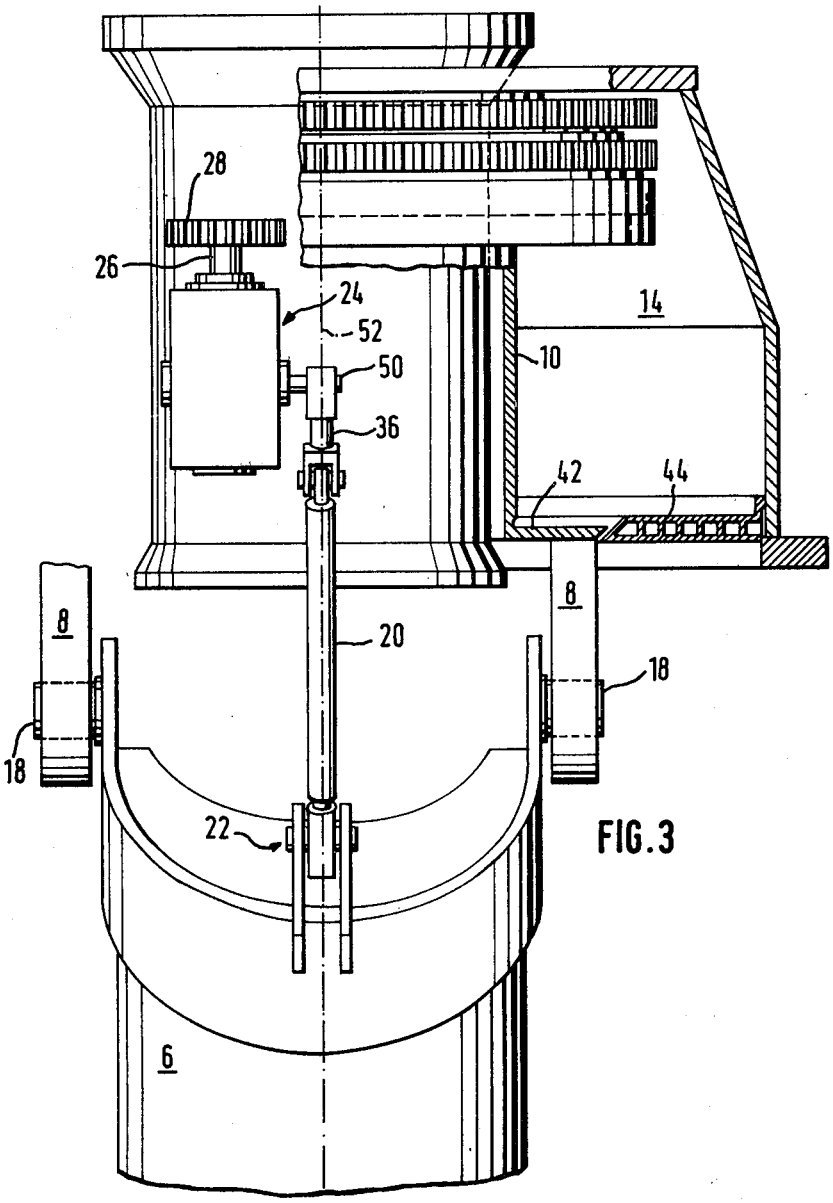
FIG. 3 is a schematic front elevation view, partly in section, of the apparatus of FIG. 1.

Referring jointly to FIGS. 1 and 3, a drive for a rotatable and angularly adjustable charge distribution chute 6 positioned within a shaft furnace, not shown, is depicted in partial cross-section. The solid charge material which is to be distributed on the hearth of the furnace in accordance with a predetermined pattern is supplied to the upper end of chute 6, under the influence of gravity, via a tubular feed channel 4. Feed channel 4 will typically be coaxial with the furnace axis 52 and will be supplied from a pressurized storage hopper or hoppers, also not shown. The distribution chute 6 is suspended from a rotatable casing 10 by means of a pair of suspension brackets 8. The mounting of chute 6 from brackets 8 is accomplished via pivot shafts 18.

The rotatable casing 10 is coaxial with the feed channel 4. Casing 10 is rotatably suspended from a support ring assembly, indicated generally at 12, which in turn is affixed to the structural members which define the outwardly disposed walls of an annular drive chamber which has been indicated generally at 14. The stationary members which define chamber 14, including the fixed outer wall 48 which is an extension of the furnace wall, are supported on a mounting flange 16 which, in turn, is hermetically sealed to the main furnace wall by means not shown. The stationary elements which define chamber 14 thus form the support for the feed channel 4 and, in addition, the support ring 12, rotatable casing 10 and distribution chute 6. The base or lower end of chamber 14 is defined by a flange 42 on casing 10 and a stationary heat shield 44.

The pivotal motion of chute 6 about the axis defined by pivot connections 18 results from ascending and descending movements of a control rod 20. Control rod 20, as may best be seen from FIG. 3, is articulated to the upper end of chute 6 via a pivot connection 22. Pivot connection 22 is spaced from the horizontal pivot axis of chute 6 by a distance "d". The movements of control rod 20 are effected by means of drive components located within a gearbox, indicated generally at 24, supported from rotary casing 10 and located within annular chamber 14. Gearbox 24 has a vertically oriented rotatable input shaft 26 which is driven, via a pinion 28 and ring gear 30, as a result of the combination of relative movements of a pair of additional ring gears 32 and 34. The manner and means of driving gears 32 and 34 so as to impart rotation to shaft 26 while casing 10 is rotating about the furnace axis does not comprise part of the present invention and is described in aforesaid co-pending application 65,289.

Gearbox 24 has at least a first rotatable, horizontally oriented, output shaft 50. Output shaft 50 is coupled to the upper end of control rod 20 via a short connecting rod 36 having a length "l" (see FIG. 2). As may be seen from FIG. 3, the connection of connecting rod 36 to control rod 20 is via an articulated coupling; i.e., a pivot joint; 38.

FIG. 2 schematically represents several different relative positions of connecting rod 36 and control rod 20 commensurate with different degrees of rotation of gearbox output shaft 50. Thus, in FIG. 2 the position d-20-1 represents the chute drive in the position represented in FIG. 1; this position being commensurate with the shallowest obtainable distribution chute inclination angle. This inclination angle would be commensurate with the deposition of the charge material on the periphery of the furnace hearth. Conversely, the chute position indicated by d″-20″-1″ comprises the opposite extreme where the chute approaches a vertical orientation. The position of connecting rod 36, and thus of control rod 20 indicated in FIG. 2 at d′-20′-1′ is intermediate between the two extremes discussed above. It is believed that FIG. 2 clearly illustrates that the geometry of the kinetic assembly defined by the spacing "d'" between the axes of pivot connections 18 and 22, the length of control rod 20 and the length "l" and position of connecting rod 36 can be selected to insure that the control rod will undergo only slight lateral movements of flange 42. This permits the size of the opening 40 in the annular flange 42 through which control rod 20 passes to be minimized. The width, in the radial direction, of flange 42 may thus itself be minimized.

The dimensions of the annular chamber 14, particularly its width in the radial direction, are primarily determined by the dimensions of the gearbox 24. As may clearly be seen from the drawing, in accordance with the present invention, through minimizing the width of the annular flange 42, the major portion of the base of annular chamber 14 may be defined by a fixed ring or hear shield 44 which is affixed to and extends radially inwardly from wall 48. Since the ring 44 does not move, it may easily be cooled and, for this purpose is provided with internal coolant flow passages 46 through which a liquid coolant will circulate. The cooling of ring 44 eliminates the need for injection of a cooled inert gas into chamber 14 to protect the drive components positioned therein from heat induced distortion and damage. The minimizing of the size of the annular flange 42, to the benefit of enhancing the width of the fixed ring 44, also precipitates the advantage of allowing the provision of liquid cooling of flange 42 to be dispensed with.

The components positioned within gearbox 24, which translate the rotation of vertical input shaft 26 into rotation of horizontal shaft 50, may include a simple worm gear drive which is schematically illustrated in FIG. 1.

FIG. 3 depicts the relationship of gearbox 24 to the furnace axis 52 and thus illustrates the asymetrical mounting of gearbox 24 on the wall of rotatable casing 10. This mounting arrangement enables the control rod 20 to be articulated to the center of the rear portion of distribution chute 2. As an alternative, the gearbox 24 could be symetrically mounted with respect to casing 10 and coupled to control rod 20 via a pair of oppositely disposed and horizontally oriented output shafts 50 with associated connecting rods 36. Also, a pair of control rods, respectively driven via a pair of such oppositely disposed output shafts, could be employed to thereby distribute the load to opposite sides of the axis of the chute 6.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An improved control for a steerable charge distribution chute of a charging device for furnaces of the type having a tubular feed channel which guides charge material delivered thereto under the influence of gravity onto a first end of the steerable charge distribution chute, the feed channel having an axis and being circumscribed by an extension of the furnace wall, the improved control device comprising:

rotatable casing means, said casing means being coaxial with and circumscribing the feed channel, said casing means cooperating with the furnace wall extension which circumscribes the feed channel to define a chamber therebetween;

means pivotally supporting the distribution chute from said casing means whereby the chute will rotate with said casing means, said supporting means positioning the chute such that the first end thereto is beneath the feed channel;

flange means affixed to said casing means, said flange means extending outwardly from said casing means toward the furnace wall extension;

heat shield means, said heat shield means being affixed to the furnace wall extension and extending inwardly therefrom, said heat shield means cooperating with said flange means to define the lower end of said chamber;

control rod means, said control rod means being pivotally connected at a first end to the distribution chute, said control rod means extending through said flange means into said chamber, movements of said control rod changing the angle of inclination of the rotatable distribution chute;

means for delivering distribution chute inclination angle command signals into said chamber, said signal delivering means including means rotatable about a first axis oriented generally parallelly with the feed channel axis;

motion translating means positioned within said chamber, said motion translating means being coupled to said signal delivering means and converting rotation of said rotatable means about said first axis to rotation of an output shaft about a second axis which is generally transverse to a plane defined by said first axis and the feed channel axis;

connecting rod means for coupling said motion translating output shaft to the second end of said control rod, said connecting rod means being articulated to the said second end of said control rod whereby rotation of said motion translating means output shaft about said second axis will impart forces having components directed parallely with the feed channel axis to said to control rod means whereby said control rod means will cause the distribution chute to pivot about said supporting means; and means partly disposed within said chamber for causing rotation of said casing means.

2. The apparatus of claim 1 wherein said motion translating means comprises:

a gearbox affixed to said casing means for rotation therewith, said gearbox having a vertical input shaft and a horizontal output shaft; and gear means responsive to rotation of said delivering means rotatable means for driving said gearbox input shaft.

3. The apparatus of claim 1 wherein said control rod means comprises:

at least a first rigid control rod, said control rod being of substantially greater length when compared to said connecting rod means, said control rod passing through an opening in said flange means.

4. The apparatus of claim 1 wherein the distance d between said distribution chute supporting means and the pivot connection between the first end of said control rod means and the distribution chute, the length of said control rod means and the length l of said connecting rod means are selected to minimize the movements in the radial direction of said control rod means at said flange means.

5. The apparatus of claim 1 wherein said heat shield means includes a path for the flow of a liquid coolant therethrough.

6. The apparatus of claim 1 wherein said heat shield means is in the form of an annular ring.

7. The apparatus of claim 2 wherein said gearbox includes:

a worm gear affixed to said input shaft; and a second gear driven by said worm gear, said outut shaft being affixed to said second gear.

8. The apparatus of claim 3 wherein said heat shield means includes a path for the flow of a liquid coolant therethrough.

9. The apparatus of claim 8 wherein said motion translating means comprises:

a gearbox affixed to said casing means for rotation therewith, said gearbox having a vertical input shaft and a horizontal output shaft; and gear means responsive to rotation of said delivering means rotatable means for driving said gearbox input shaft.

10. The apparatus of claim 9 wherein said gearbox includes:

a worm gear affixed to said input shaft; and a second gear driven by said worm gear, said output shaft being affixed to said second gear.

* * * * *